US006662854B2

(12) United States Patent
Woodson et al.

(10) Patent No.: US 6,662,854 B2
(45) Date of Patent: Dec. 16, 2003

(54) COLD-BOX FOUNDRY BINDER SYSTEMS HAVING IMPROVED SHAKEOUT

(75) Inventors: Wayne D. Woodson, Georgetown, IL (US); H. Randall Shriver, Columbus, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/117,462

(22) Filed: Apr. 5, 2002

(65) Prior Publication Data

US 2003/0188846 A1 Oct. 9, 2003

(51) Int. Cl.[7] ..... B22C 1/14

(52) U.S. Cl. ..... 164/138; 164/16; 164/526; 523/139; 523/144; 523/145; 523/147; 523/148; 523/466

(58) Field of Search ..... 523/139, 144, 523/145, 147, 148; 513/466; 164/16, 526, 138

(56) References Cited

U.S. PATENT DOCUMENTS 4,176,114 A 11/1979 Stewart et al. ..... 260/42.29
4,518,723 A 5/1985 Woodson et al. ..... 523/466
4,526,219 A 7/1985 Dunnavant et al. ..... 164/16

FOREIGN PATENT DOCUMENTS

WO WO 90/02773 * 3/1990

OTHER PUBLICATIONS

"Development of an Epoxy Resin Core Binder with Good Breakdown Performance", M. Kondo, M. Ohkawara and T. Murai, pp. 100–103, JSEA Review, Jul. 1988.

* cited by examiner

*Primary Examiner*—Robert Dawson
*Assistant Examiner*—D. Aylward
(74) *Attorney, Agent, or Firm*—David L. Hedden

(57) ABSTRACT

This invention relates to foundry binder systems, which will cure in the presence of sulfur dioxide and a free radical initiator, comprising (a) an aliphatic epoxy resin; (b) a multifunctional acrylate; and (c) an effective amount of a free radical initiator. The foundry binder systems are used for making foundry mixes. The foundry mixes are used to make foundry shapes (such as cores and molds) which are used to make metal castings, particularly aluminum castings.

9 Claims, No Drawings

COLD-BOX FOUNDRY BINDER SYSTEMS HAVING IMPROVED SHAKEOUT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to foundry binder systems, which will cure in the presence of sulfur dioxide and a free radical initiator, comprising (a) an aliphatic epoxy resin; (b) a multifunctional acrylate; and (c) an effective amount of a free radical initiator. The foundry binder systems are used for making foundry mixes. The foundry mixes are used to make foundry shapes (such as cores and molds) which are used to make metal castings, particularly aluminum castings.

(2) Description of the Related Art

In the foundry industry, one of the procedures used for making metal parts is "sand casting". In sand casting, disposable molds and cores are fabricated with a mixture of sand and an organic or inorganic binder. The foundry shapes are arranged in casting assembly, which results in a cavity into which molten metal is poured. The binder is needed so the molds and cores will not disintegrate when they come into contact with the molten metal. After the molten metal is poured into the assembly of molds and cores and cools, the metal part formed by the process is removed from the assembly.

Two of the prominent fabrication processes used in sand casting are the no-bake and the cold-box processes. In the no-bake process, a liquid curing catalyst is mixed with an aggregate and binder to form a foundry mix before shaping the mixture in a pattern. The foundry mix is shaped by putting it into a pattern and allowing it to cure until it is self-supporting and can be handled. In the cold-box process, a gaseous curing catalyst is passed through a shaped mixture (usually in a corebox) of the aggregate and binder to cure the mixture.

The core or mold produced from the binder must maintain its dimensional accuracy during the pouring of the metal, but disintegrate after the metal cools, so that it can be readily separated from the metal part formed during the casting process. Otherwise, time consuming and labor intensive means must be utilized to break down (shakeout) the bonded sand, so that the metal part can be removed from the casting assembly. This is particularly a problem with internal cores, which are imbedded in the casting assembly and not easily removed. Usually, mechanical energy is applied to the casting to facilitate removal. If the core does not break down sufficiently during the metal solidification and cooling stage, the core is difficult to remove and requires excessive mechanical rapping to remove it, or in extreme cases may require baking at temperatures exceeding 425° C. for extended periods to thermally degrade the core. This can result in substantial productivity losses as well as excess energy usage.

In iron or steel casting, the pouring temperature is typically around 1550° C. These high pour temperatures facilitate the break down of the core. However, in the case of light metals such as aluminum, core breakdown is compounded because of the relatively low pouring temperature of the metal. For instance, aluminum is typically poured at a temperature of around 725° C. Not only does this lower pouring temperature not facilitate core breakdown, but the aluminum casting cools quicker than a iron casting of similar dimensions, so that core breakdown is not facilitated as readily during the cooling stage of the casting. In view of these circumstances, core removal is a common problem in aluminum casting, there is a need for improved binders that will produce cores, which will not only provide good cores and castings, but will result in good core removal.

U.S. Pat. No. 4,176,114 discloses a poly(furfuryl alcohol) binder composition, which is mixed into an aggregate along with an organic peroxide (preferably methylethyl ketone peroxide, MEKP). The mixture is shaped into a mold or core and gassed with sulfur dioxide. The sulfur dioxide is oxidized by the peroxide and a strong acid generated, which polymerizes the poly(furfturyl alcohol) and hardens the mold. This binder is sold under the trade name "INSTADRAW". The binder provides cores that are easy to remove from an aluminum castings. In fact, core removal times are significantly less than those where phenolic urethane cold-box binders are used to prepare the cores.

Nevertheless, the INISTRADRAW binder has two drawbacks. First, when the binder was actually used in a foundry, a chemically resistant poly(furfuryl alcohol) coating slowly deposited on the core box tooling. This deposit was very tough to remove, and if was not periodically removed, cores would stick in the tooling and dimensional accuracy would suffer. Secondly, the methylethyl ketone peroxide (MEKP) free radical generator had to handled as a separate part, and could only be shipped in small containers. This constituted a safety hazard if not handled properly. The MEKP catalyst was not storage stable when blended with the polyfurfuryl alcohol resin, and no other diluent for the MEKP could be found which was compatible with the system. Though this system is still sold commercially, it's commercial growth has been hindered by these drawbacks.

U.S. Pat. No. 4,518,723 discloses a binder, which is a mixture of an aromatic epoxide resin, such as bisphenol-A epoxy, blended with a multifunctional acrylate, such as trimethyolpropane triacrylate (TMPTA), and cumene hydroperoxide. This composition is mixed with an inorganic aggregate, e.g. sand, shaped, and gassed with sulfur dioxide. This use of this binder does not result in deposit formation on core box tooling during actual practice in a foundry, and was safer to use than the INSTRAWDRAW binder because the cumene hydroperoxide could be diluted in epoxy resin to form a storage-stable solution. It also made cores with much greater tensile strength with a greater variety of inorganic aggregates. This binder system, known as ISOSET® binders, is commercially successful and sold by Ashland Specialty Chemical Company. Although cores made with ISOSET binders have faster shakeout in aluminum casting operations than phenolic urethane cold-box binders, they do not have the fast shakeout characteristics of the poly (furfturyl alcohol) binders. Therefore, there is a need for binders that will produced cores with the fast shakeout characteristics of cores made with the poly(furfuryl alcohol) binder, without sacrificing the tensile properties of the cores, productivity, or the clean operating characteristics of the epoxy/acrylate system.

BRIEF SUMMARY OF THE INVENTION

The subject invention relates to foundry binder systems, which cure in the presence of vaporous sulfur dioxide and a free radical initiator, comprising:

(a) 20 to 70 parts by weight of an aliphatic epoxy resin;

(b) 10 to 50 parts by weight of a monomeric or polymeric acrylate monomer; and (c) an effective amount of a hydroperoxide, where (a), (b), and (c) are separate components or mixed with another of said components, provided (b) is not mixed with (c), and where said parts by weight are based upon 100 parts of binder.

The binders produce cores, which breakdown (shakeout) more easily and can be more rapidly removed from the casting. This advantage is particularly important when the castings are made from light-weight metals, e.g. aluminum. This improvement results without detrimentally affecting the tensile properties of the core or productivity.

This improvement is very significant from a commercial standpoint. The ability to remove core sand from a casting in less time boosts productivity and reduces labor costs, because, for most aluminum casters, the bottleneck in production is the core removal.

Also, the quality of the castings is improved because all of the sand from the cores used in making the casting can be removed from the casting before use. Many casting operations, such as automotive and aerospace, cannot tolerate even a single grain of sand remaining in the casting. The binders of this invention produce cores and molds which breakdown readily, and enable the sand to be removed quickly and cleanly, requiring no drilling, sandblasting, power brushing, or high temperature post-baking.

The foundry binders are used for making foundry mixes. The foundry mixes are used to make foundry shapes, such as cores and molds, which are used to make metal castings.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

For the purpose of describing this invention, "aliphatic epoxy resin" includes any aliphatic, cycloaliphatic, or mixed aliphatic-cycloaliphatic epoxide having any aliphatic groups, and further includes aliphatic epoxy resins having aromatic groups, i.e. mixed aliphatic-aromatic epoxy resins. The aliphatic epoxy resin may contain monomeric epoxide compounds in admixture with polymeric epoxide compounds.

The most preferred aliphatic epoxy resins are represented by the following structural formulae:

(I)

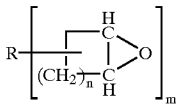

where "n"≧1 and "m" is a whole number, typically from 1 to 4, preferably from 2–3, or (II)

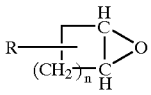

R in structures I and II is predominantly aliphatic in nature, but may contain oxygen functionality as well as mixed aliphatic-aromatic groups. Typically, R is selected from the group consisting of alkyl groups, cylcoalkyl groups, mixed alkyl-cycloaliphatic groups, and substituted alkyl groups, cylcoalkyl groups, or alkyl-cycloaliphatic groups, where the substituents include, for example, ether, carbonyl, and carboxyl groups.

The epoxide functionality of the epoxy resin can range from 1.8 to 3.5, but is typically equal to or greater than 2.0, more typically from 2.3 to 3.5. Particularly preferred are aliphatic epoxy resins having an average weight per epoxy group of 100 to 300, preferably 120 to 250.

Useful aliphatic epoxides include glycidyl ethers prepared from aliphatic polyols useful in this invention include glycidyl ethers of trimethylolpropane, 1,4-butanediol, neopentyl glycol, hydrogenated bisphenol-A, cyclohexane dimethanol, sorbitol, glycerin, hexanediol, pentaerythritol, 2,5-bis(hydroxymethyl)tetrahydrofuran, and the like. Glycidyl ethers of aliphatic polyols containing unsaturation, such as 2-butynediol, may also be used. Cycloaliphatic epoxide compounds which are useful include 3,4-epoxycyclohexylmethyl 3,4-epoxy-cyclohexane-carboxylate (ERL 4221 from Union Carbide), bis (3,4-Epoxycyclohexyl methyl) adipate, 1,2 epoxy-4-vinylcyclohexane, and the like. Epoxides prepared from peracid epoxidation of polyunsaturated hydrocarbons are also useful. Other epoxide compounds expected to be useful include glycidyl esters of polycarboxylic acids, thioglycidyl resins prepared from mercaptans, and silicone glycidyl resins.

The free radical initiator (c) is a peroxide and/or hydroperoxide. Examples include ketone peroxides, peroxy ester free radical initiators, alkyl oxides, chlorates, perchlorates, and perbenzoates. Preferably, however, the free radical initiator is a hydroperoxide or a mixture of peroxide and hydroperoxide. Hydroperoxides particularly preferred in the invention include t-butyl hydroperoxide, cumene hydroperoxide, paramenthane hydroperoxide, etc. The organic peroxides may be aromatic or alkyl peroxides. Examples of useful diacyl peroxides include benzoyl peroxide, lauroyl peroxide and decanoyl peroxide. Examples of alkyl peroxides include dicumyl peroxide and di-t-butyl peroxide.

Cumene hydroperoxide and/or a multifunctional acrylate, such as trimethylolpropane triacrylate, may be added to the epoxy resin before mixing it with the foundry aggregate. Optionally, a solvent or solvents may be added to reduce system viscosity or impart other properties to the binder system such as humidity resistance. Examples of solvents include aromatic hydrocarbon solvents, such as such as o-cresol, benzene, toluene, xylene, ethylbenzene, and naphthalenes; reactive epoxide diluents, such as glycidyl ether; or an ester solvent, such as dioctyl adipate, rapeseed methyl ester, and the like, or mixtures thereof. If a solvent is used, sufficient solvent should be used so that the resulting viscosity of the epoxy resin component is less than 1,000 centipoise, preferably less than 400 centipoise.

The reactive unsaturated acrylic monomer, polymer, or mixture thereof (c) contains ethylenically unsaturated bonds. Examples of such materials include a variety of monofunctional, difunctional, trifunctional, tetrafunctional and pentafunctional monomeric acrylates and methacrylates. A representative listing of these monomers includes alkyl acrylates, acrylated epoxy resins, cyanoalkyl acrylates, alkyl methacrylates, cyanoalkyl methacrylates, and difunctional monomeric acrylates. Other acrylates, which can be used, include trimethylolpropane triacrylate, methacrylic acid and 2-ethylhexyl methacrylate. Typical reactive unsaturated acrylic polymers, which may also be used include epoxy acrylate reaction products, polyester/urethane/acrylate reaction products, acrylated urethane oligomers, polyether acrylates, polyester acrylates, and acrylated epoxy resins.

Although solvents are not required for the reactive unsaturated acrylic resin, they may be used. Typical solvents used are generally polar solvents, such as liquid dialkyl esters, e.g. dialkyl phthalate of the type disclosed in U.S. Pat. No. 3,905,934, and other dialkyl esters such as dimethyl glutarate. Methyl esters of fatty acids, particularly rapeseed methyl ester, are also useful solvents. Suitable aromatic solvents are benzene, toluene, xylene, ethylbenzene, and mixtures thereof.

Although the components can be added to the foundry aggregate separately, it is preferable to package the epoxy novolac resin and free radical initiator as a Part I and add to the foundry aggregate first. Then the ethylenically unsaturated material, as the Part II, either alone or along with some of the epoxy resin, is added to the foundry aggregate.

Typically, the amounts of the components used in the binder system are from 20 to 70 weight percent of aliphatic epoxy resin, preferably from 50 to 60 weight percent; 10 to 25 weight percent of free radical initiator, preferably from 15 to 20 weight percent; and 10 to 50 weight percent of multifunctional acrylate, preferably from 15 to 35 weight percent, where the weight percent is based upon 100 parts of the binder system.

It will be apparent to those skilled in the art that other additives such as silanes, silicones, benchlife extenders, release agents, defoamers, wetting agents, etc. can be added to the aggregate, or foundry mix. The particular additives chosen will depend upon the specific purposes of the binder.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used are known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

The foundry mix is molded into the desired shape by ramming, blowing, or other known foundry core and mold making methods. The shape is then cured almost instantaneously by the cold-box process, using vaporous sulfur dioxide as the curing agent (most typically a blend of nitrogen, as a carrier, and sulfur dioxide containing from 35 weight percent to 65 weight percent sulfur dioxide), described in U.S. Pat. Nos. 4,526,219 and 4,518,723, which are hereby incorporated by reference. The shaped article is preferably exposed to effective catalytic amounts of 100 percent vaporous sulfur dioxide, although minor amounts of a carrier gas may also be used. The exposure time of the sand mix to the gas is typically from 0.5 to 3 seconds. Although the foundry shape is cured after gassing with sulfur dioxide, oven drying is needed if the foundry shape is coated with a refractory coating.

The core and/or mold may be formed into an assembly. Optionally, when making castings, the core and/or mold may be coated with a water-based refractory coating and subsequently dried. The item is then ready to be handled for further processing.

ABBREVIATIONS

The abbreviations used in the examples are as follows:

| | |
|---|---|
| CHP | cumene hydroperoxide (9.0% active oxygen). |
| BPA GE | an aromatic epoxy resin derived from bisphenol-A and glycidyl ether, having an approximate EEW of 188. |
| DOA | dioctyl adipate, an ester solvent. |
| EEW | epoxide equivalent weight. |
| EPALLOY 5000 | a cycloaliphatic epoxy resin, which is prepared by hydrogenating bisphenol-A glycidyl ether, manufactured by CVC Specialty Chemicals. |
| ERL-4221 | an aliphatic epoxy resin, 3,4-epoxycyclohexylmethyl 3,4-epoxy-cyclohexane-carboxylate, manufactured by Union Carbide. |
| ERISYS GE-30 | an aliphatic epoxy resin prepared by reacting trimethylolpropane and glycidyl ether, manufactured by CVC Specialty Chemicals. |
| HI-SOL 15 | aromatic solvent. |
| RA | release agent. |
| SCA | silane coupling agent. |
| TMPTA | trimethyolpropane triacrylate, an unsaturated monomer. |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated.

The components of the Part I and Part II of the binder were blended for 3 minutes using a Hobart sand mixer. Test cores were prepared by adding 0.8 weight percent of the binder (the Part I was added first) to 2000 grams of Badger 5574 silica sand, such that the ratio of Part I/Part II was 1:1, blowing the mixture at 40 psi, using a Gaylord MTB-3 core blowing unit, gassing it with 50% sulfur dioxide in nitrogen for 1.5 seconds, and then purging with air for 10 seconds. "Dog bone" shaped cores were used to test the tensile strengths of the cores and "wedge-shaped" or "trapezoid-shaped" cores were used to test the shakeout of the cores. The cores were allowed to post cure at room temperature for 24 hours before testing.

The base of the symmetrical trapezoid test core measures 4", the height is 5" and the top is 1.75" wide. The core has a uniform thickness of 1.5". Extending from the bottom plane and the top plane are two and one 1" tall cylinders with a diameter of 0.75", respectively. The spacing of the cylinders extending from the bottom plane is 2.25", center to center. These "core prints" hold the core in place in the mold, so that a uniform casting wall thickness of 0.25" results.

The test cores were used as internal cores to make an aluminum casting. A test core was placed in the bottom half of a sand mold designed for placement of the test core. Then the top half of the mold, which contained a sprue through which metal could be poured, was inserted on top of the bottom half.

Molten Aluminum 319 having a temperature of 730° C. was poured into the casting assembly and then allowed to cool. The resulting aluminum casting was a hollow trapezoid having a thickness of 0.25". There is one 0.75" hole in the center of the top end face of the trapezoid and two holes in the bottom end face of the casting.

One side of the casting had a 2"×2"×2" block of metal protruding from it that is used to attach the aluminum casting to the Herschal hammer during the shakeout test. The shakeout tests were conducted at room temperature (cold) by attaching the aluminum casting to a 40 psi mechanical Herschal hammer to the protrusion on the trapezoid test casting. The Herschal hammer applied pressure on the casting at 15 second intervals until the internal core was removed from the aluminum casting through the holes in the test core. The amount of sand exiting the casting from the hole on the 1.5 inch face of the trapezoid casting was measured every 15 seconds. The amount of sand that pours out of the bottom hole is calculated for each interval. The test is stopped if all of the core sand is removed before 120 seconds.

Comparative Example A (Use of an Aromatic Epoxy Resin)

A two-part binder system, described as follows, was prepared.

| | |
|---|---|
| Part I: | |
| BPA GE | 65% |
| CHP | 35 |
| Part II: | |
| BPA GE | 49.73% |
| TMPTA | 42.32 |
| Aromatic Solvent | 3.5 |
| Ester Solvent | 3.5 |
| Release agent | 0.4 |
| Silane coupling agent | 0.55 |

19.2 grams of Part I and 12.8 grams of Part II are added to 4000 grams of Badger 5574 silica sand. The components are mixed for 4 minutes in a Hobart mixer. The thoroughly mixed sand/resin mixture is then blown into a mold and gassed 1 second with a 50/50 Nitrogen/SO2, followed by a 10 second air purge. The hardened core is then removed and allowed to age 24 hours. The tensile strength of the core at 24 hours was 132 psi. The core was then placed into a mold and molten aluminum at about 730° C. is poured into the assembly. After 20 minutes the aluminum casting, which contains the partially decomposed core inside, is removed from the mold and placed on the Herschel shaker. The casting is weighed at the intervals previously stated, and the percent sand remaining at each interval is calculated. After 120 seconds, 85% of the sand was removed from the casting.

Example 1

(Use of Aliphatic Epoxy Resin/Erisys GE-30)

A two part binder system, described as follows, was prepared.

| | |
|---|---|
| Part I: | |
| Erisys GE-30 | 70% |
| CHP | 30 |
| Part II: | |
| TMPTA | 50.0% |
| Erisys GE-30 | 49.6 |
| A-187 Silane | 0.4 |

16 grams of Part I and 16 grams of Part II were added to 4000 grams of Badger 5574 sand. A test core was prepared as in Example 1. The tensile strength after 24 hours was 128 psi. The shakeout properties of the core was tested as in Example 1. After 30 seconds, 100% of the core sand had been shaken from the casting. By comparison, in Comparative Example A only 40% of the sand was removed in 30 seconds.

Example 2

(Use of Aliphatic Epoxy Resin/Epalloy 5000)

A two part binder was prepared.

| | |
|---|---|
| Part I: | |
| Epalloy 5000 | 65% |
| CHP | 35 |
| Part II: | |
| TMPTA | 50.0% |
| Erisys GE-30 | 49.6 |
| A-187 silane | 0.4 |

16 grams of Part I and 16 grams of Part II were added to 4000 grams of Badger 5574 sand. A test core was prepared as in example 1. The tensile strength after 24 hours was 131 psi. The test core was evaluated as in Example 1. In 5 seconds, 100% of the sand had shaken out of the casting. By contrast, in Comparative Example A, only 8% of the sand was removed after 5 seconds.

Example 3

(Use of Aliphatic Epoxy Resin/ERL 4221)

A two part binder system was prepared.

| | |
|---|---|
| Part I: | |
| ERL 4221 | 70% |
| CHP | 30 |
| Part II: | |
| TMPTA | 49.40% |
| Epalloy 5000 | 25. |
| ERL 4221 | 25 |
| A-187 Silane | 0.6 |

16 grams of Part I and 16 grams of Part II was mixed into 4000 grams of Badger 5574 sand. A test core was prepared as in Example I and evaluated as previously described. The tensile strength after 24 hours was 138 psi. In 30 seconds, 100% of the sand was removed from the casting.

Comparative Example B (Comparison With Commercial Binder)

A two part amine cured phenolic urethane cold-box system was evaluated. This system, known as ISOCURE®

393N/693N binder (sold by Ashland Specialty Chemicals, a division of Ashland Inc.) was designed specifically for aluminum applications and is considered to be one of the best amine cured systems for this purpose.

In a mixer, 17.6 grams of ISOCURE® 393 and 14.4 grams of ISOCURE® 693 were added to 4000 grams of Badger 5574 sand. The sand was thoroughly mixed and the mix was blown into the mold as previously described, but gassed 1.5 seconds with a triethyl amine/air stream. A test core was prepared as in Example 1 and evaluated as previously described. The tensile strength after 24 hours was 150 psi. After 120 seconds, 94% of the sand was removed.

Table I summarizes the data from the tensile tests and shakeout tests conducted on cores made from the binders of Comparative Examples A and B, and Examples 1–3.

TABLE I (Summary of data related to time to shakeout 100% of sand from test casting)

| Example | Tensile Strength (psi) after 24 hours | Shakeout Time (seconds) |
|---|---|---|
| A | 132 | >120 (only 85% of sand shaken out after 120 seconds) |
| 1 | 128 | 30 |
| 2 | 131 | 5 |
| 3 | 138 | 30 |
| B | 150 | >120 (only 94% of sand was removed after 120 seconds) |

The data in Table I clearly show the improvement in core shakeout, which results when an aliphatic epoxy resin is used to formulate the binder. This improvement is very significant from a commercial standpoint. The ability to remove core sand from a casting in less than 1/10 of the time now required with current technology is of huge importance, particularly with respect to the casting of aluminum parts. Time and labor is significantly reduced, boosting productivity, because, for most aluminum casters, the bottleneck is the shakeout time.

Also, the quality of the castings is much improved because all of the sand from the cores used in making the casting can be removed from the casting before use. Many casting applications, such as automotive and aerospace, have very strict and low tolerances for residual sand in the casting. The binders of this invention produce cores and molds which breakdown readily, and enable the sand to be removed quickly and cleanly, requiring no drilling, sandblasting, power brushing, or high temperature post-baking.

We claim:

1. A foundry binder system, comprising:

(a) 20 to 70 parts by weight of an aliphatic epoxy resin having an epoxide equivalent weight of about 100 to about 300 selected from the group consisting of epoxy resins represented by the following structural formulae:

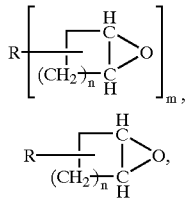

and mixtures thereof, where m is a whole number from 1 to 4, n≧1, and "R" is a predominately aliphatic substituent, (b) 10 to 50 parts by weight of a monomeric or polymeric acrylate monomer; and (c) an effective amount of a peroxide, where (a), (b), and (c) are separate components or mixed with another of said components, provided (b) is not mixed with (c), and where said parts by weight are based upon 100 parts of binder.

2. The binder system of claim 1 wherein the epoxy resin has an epoxide equivalent weight of about 100 to about 300.

3. The binder system of claim 2 wherein the acrylate is a monomer and the monomer is trimethyolpropane triacrylate and the peroxide is a hydroperoxide.

4. The binder system of claim 3 wherein the hydroperoxide is cumene hydroperoxide.

5. A foundry mix comprising:

(a) a major amount of foundry aggregate;

(b) effective bonding amount of the foundry binder system of claim 1, 2, 3, or 4.

6. A cold-box process for preparing a foundry shape comprising:

(a) introducing the foundry mix of claim 5 into a pattern; and (b) curing with gaseous sulfur dioxide.

7. A foundry shape prepared in accordance with claim 6.

8. A process of casting a metal article comprising:

(a) fabricating an uncoated foundry shape in accordance with claim 6;

(b) pouring said metal while in the liquid state into said coated foundry shape; and (c) allowing said metal to cool and solidify; and (d) then separating the molded article.

9. A casting prepared in accordance with claim 8.

* * * * *